United States Patent [19]

Tawfik

[11] 4,366,461

[45] Dec. 28, 1982

[54] CYCLING RESISTANT FUSIBLE ELEMENT FOR ELECTRIC FUSES

[75] Inventor: Randa Tawfik, Seabrook, N.H.

[73] Assignee: Gould Inc., Rolling Meadows, Ill.

[21] Appl. No.: 276,392

[22] Filed: Jun. 22, 1981

[51] Int. Cl.[3] ..... H01H 85/04

[52] U.S. Cl. ..... 337/159; 29/623; 337/290

[58] Field of Search ..... 337/290, 159; 29/623

[56] References Cited

U.S. PATENT DOCUMENTS 3,940,728 2/1976 Komatsu et al. ..... 337/290

*Primary Examiner*—Harold Broome

*Attorney, Agent, or Firm*—Frederick A. Goettel, Jr.

[57] ABSTRACT

A fusible element having an ability to withstand a large number of on-off cycles is provided. The element comprises a ribbon of copper without any M-effect causing means. The element is bent in a zig-zag shape to establish a plurality of contiguous planar sections enclosing obtuse angles with each other and forming straight edges of the loci of intersection of the planes defined by the planar sections. The straight edges are non-perforated to maximize their flexure strength. Each of the planar sections is provided with at least one point of reduced cross-section remote from the straight edges. The ribbon of copper is electro-plated with sulfamate of nickel forming a dull, ductile layer of nickel.

3 Claims, 5 Drawing Figures

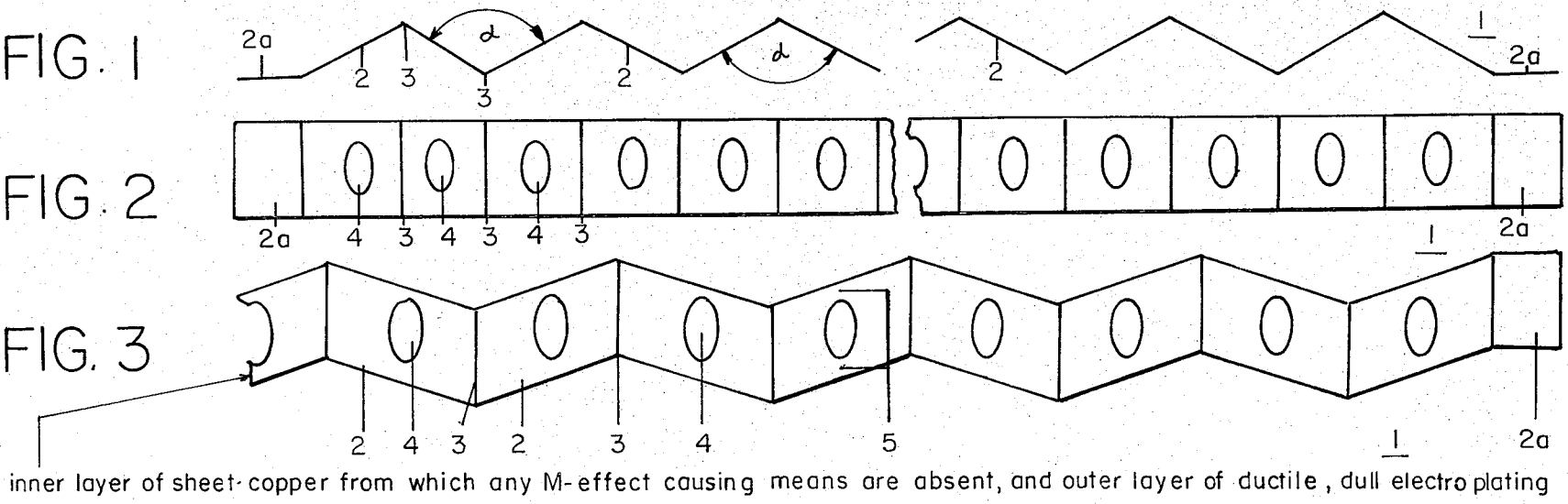
FIG. 1
FIG. 2
FIG. 3
inner layer of sheet-copper from which any M-effect causing means are absent, and outer layer of ductile, dull electroplating in a bath of sulfamate of nickel
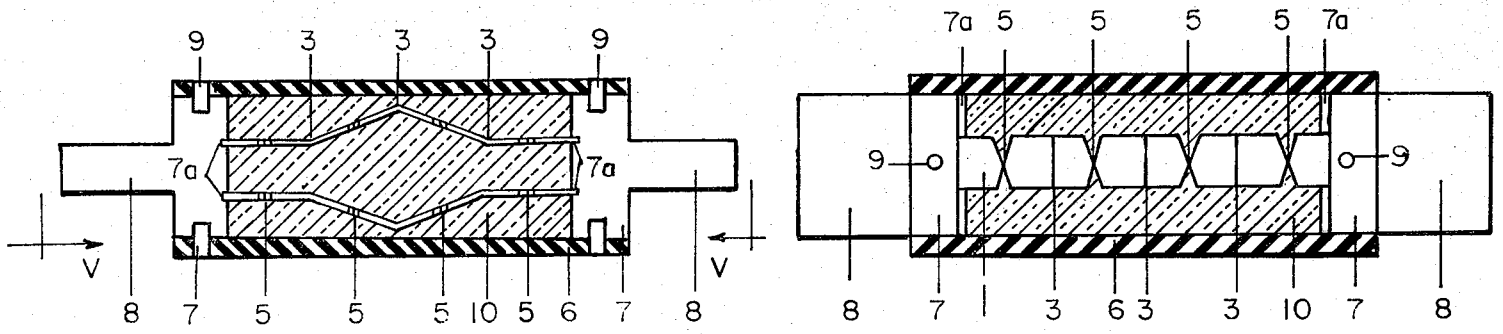
FIG. 4
FIG. 5

CYCLING RESISTANT FUSIBLE ELEMENT FOR ELECTRIC FUSES

BACKGROUND OF THE INVENTION

Up to now fusible elements which had to perform a high cycling duty were generally made of silver. The rising price of silver has raised the question whether any other less expensive metal than silver could be substituted for silver. Extensive experiments were carried out with fusible elements of copper and with fusible elements of aluminum. The results of these experiments were rather unsuccessful. Copper forms on account of its oxidation a brittle layer around the fusible element inconsistent with high cycling performance.

Oxidation of copper occurs over a wide range of temperatures, beginning at room temperature and forming oxides that are not only brittle but also fissured, exposing also the underlying copper layer to oxidation. For this and other reasons, the cycling ability of prior art fusible elements of copper was extremely poor. Nor have fusible elements of aluminum been able to provide a satisfactory cycling performance.

High cycling ability fusible elements in ribbon form were, therefore, made exclusively of silver.

Prior art fusible elements designed to have a high cycling performance are disclosed, e.g. in U.S. Pat. No. 3,319,029 to P. C. Jacobs, Jr. for HIGH-VOLTAGE FUSE HAVING ZIG-ZAG SHAPED FUSE LINK; 5/9/67; U.S. Pat. No. 3,394,333 to P. C. Jacobs, Jr. for ELECTRIC FUSE HAVING STRESS-REDUCING FUSE LINK MEANS; 6/23/68; U.S. Pat. No. 4,161,713 to P. C. Jacobs, Jr. for FUSIBLE ELEMENT FOR ELECTRIC FUSES HAVING A RELATIVELY HIGH VOLTAGE RATING AND A RELATIVELY HIGH CYCLING PERFORMANCE; 7/17/79; etc. All the fusible elements described in these patents were of silver.

The present invention solves the problem of providing an inexpensive fusible element having a cycling-resist ability surpassing the cycling resist ability of any prior art fusible element.

Another object of the invention is to provide fusible elements of copper that do not oxidize and have a high cycling ability.

Other objects of this invention and advantages thereof will become more apparent as this specification proceeds.

SUMMARY OF THE INVENTION

A fusible cycling resistant element according to this invention includes a ribbon of copper without any M-effect causing means. The fusible element is bent in zig-zag shape to establish a plurality of contiguous planar sections enclosing obtuse angles with each other and forming straight edges at the loci of intersection of the planes defined by said sections. Said straight edges are non-perforated to maximize the flexural strength thereof, and said sections each have at least one point of reduced cross-section remote from said straight edges. Said ribbon of copper is electroplated with sulfamate of nickel forming a dull, ductile layer of nickel. The thickness of said layer is in the order of several ten thousandth parts of an inch., preferably 0.0002" to 0.00035".

It has been found desirable in manufacturing such a fusible element that the process of bending the copper ribbon to zig-zag shape, or of crimping the copper ribbon, follows the electroplating step of the ribbon.

BRIEF DESCRIPTION OF THE DRAWINGS

FIG. 1 is a side elevation of the fusible element according to this invention for elevated circuit voltages, e.g. from 5 to 15 Kv;

FIG. 2 is a front view of the fusible element shown in FIG. 1;

FIG. 3 is an isometric view of a portion of a fusible element according to FIG. 1;

FIG. 4 shows a horizontal section through a fuse embodying the present invention; and FIG. 5 is a section along V—V of FIG. 4; the fuses shown in FIGS. 4 and 5 being low voltage fuses.

DESCRIPTION OF PREFERRED EMBODIMENT

Reference numeral 1 has been applied to generally indicate a ribbon of sheet copper having a thickness in the order of e.g. about one tenth of an inch. The ribbon 1 is not provided with any M-effect causing means which, if present, would serve to reduce the temperature at which the ribbon would melt. This is necessary because an M-effect causing overlay fuses at temperatures which the fusible element of high cycling ability fuses should be allowed to reach, and because even partial fusion of such an overlay affects the time-current characteristic of the fuse. The ribbon 1 is bent in zig-zag shape to establish a plurality of contiguous planar sections 2 enclosing obtuse angles $\alpha$ with each other and forming straight edges 3 at the loci of intersection of the planes defined by said sections. Edge 3 are non-perforated to maximize the flexual strength thereof. Sections 2 are provided with at least one point of reduced cross-section 5 remote from edges 3 formed as shown in FIG. 3 by two parallel current paths. Connector tabs **2*a* are provided on each end of fusible ribbon 1. Ribbon 1** is electroplated with sulfamate of nickel to prevent oxidation of the copper, providing a dull protective layer of high ductility. The thichness of the plating is in the order of ten thousandth parts of an inch, e.g. 0.0002 of an inch.

In FIGS. 4 and 5 the same reference characters have been applied to indicate like parts as in FIGS. 1 to 3. Hence, FIGS. 4 and 5 call for a description only to the extent that parts in addition to those shown in FIGS. 1–3 have been shown therein.

According to FIGS. 4 and 5 two fusible elements 1 are enclosed in a tubular housing 6. The ends of housing 6 are plugged by terminal plugs 7 from which blade contacts 8 project in opposite directions. Steel pins 9 project through housing 6 into terminal plugs 7 to hold these two parts together. The axially inner end surface of plugs 7 are provided with groves **7*a* into which the ends of fusible elements 1 extend and wherein they are conductively connected by soft solder joints (not shown) to terminal plugs 7. Reference numeral 10 indicates a granular arc-quenching filler such as, e.g. quartz sand in which fusible elements 1** are embedded.

The electroplating technology with sulfamate of nickel is well known in the electroplating art and, therefore, does not require any detailed description. Suffice it to state that nickel plating sulfamate baths are commercially available, and that nickel sulfamate has the chemical formula $Ni(SO_3NH_2)_2$.

The high cycling ability of fusible elements according to this invention is not soly attributable to their being electroplated with sulfamate of nickel. It is essential that the angle $\alpha$ between the sectors 2 be an obtuse angle because if that angle were an acute angle the cycling ability of the fusible elements would be greatly decreased by metal fatigue. It is also important that the edges 3 and the points of reduced cross-section 5 be located on different parts of the fusible element so that the points of maximal stress which are the edges 3 are not weakened by the perforations 4 by which the points of reduced cross-section 5 are established.

It is further desirable, as mentioned above, to crimp the fusible element into zig-zag shape after it has been electroplated with sulfamate of nickel. The manufacture of such a fusible element hence includes the following sequential steps: Stamping perforations 4 into a planar ribbon of copper to establish a plurality of serially arranged points of reduced cross-section. Thereafter electroplating said ribbon with sulfamate of nickel to a thickness in the order of ten thousandth parts of an inch. Thereafter said strip of copper is bent between said points of reduced cross-section at obtuse angles to zig-zag shape.

It is important to point out that the term electroplated with sulfamate of nickel, or in a sulfamate nickel plating bath, may have different meanings depending on whether it is used in the trade, or in a scientific publication. In the trade it means nickel electroplating produced in a sulfamate bath resulting in a dull appearance of the plated surface and a high ductility of the surface. It is in this sense that the above term is used in this context.

It is known, however, to plating scientists that by varying the parameters of a standard sulfamate bath very different results from those ordinarily achieved with such a bath may be obtained. Thus it is possible to achieve with a nickel sulfamate solution extremely brittle rather than ductile overlays if the object to be plated is deposited in a nickel sulfamate solution at a high current density, i.e. a current density higher than 40 Amps/dm$^2$. It has also been reported that special processes in a sulfamate bath yielded bright plating. Such deviations from standard or established sulfamate bath procedures are not considered in this context.

It is well known to use electroplated dull and ductile nickel layers for protection against oxidation. But this has not been done in any art akin to fuse technology, and under conditions not similar to those to which a fusible element in a fuse is subjected. This is apparent from what follows:

Copper has a melting point which is much lower than the melting point of nickel and a vaporization point which is much lower than that of nickel. To be more specific, nickel has a melting point of 1450° C., while copper has a melting point of only 1083° C. Nickel has a vaporization point of 3075° C. while copper has a vaporization point of only 2340° C. Thus a solid outer envelope of dull ductile nickel is formed when the fuse blows which contains a liquid insert of copper. Due to its critical small wall thickness the outer envelope bursts, resulting in arc initiation without any significant time delay. Since what is contained within the envelope-forming nickel layer is, in essence, pure copper rather than various oxides thereof, the fusing $i^2 \cdot t$ of a composite fusible element according to this invention is relatively low. The formation of series breaks occurs before the $i^2 \cdot t$ value required for vaporization of the liquefied copper inside the outer nickel sheet occurs.

It may be added that in carrying the invention into effect the difference in specific electric resistance of the outer nickel layer and the inner copper core cannot be disregarded. The specific resistance of pure nickel is in the order of 0.070 and that of pure copper in the order of 0.017. The nickel layer, in spite of its relatively small thickness and its relatively high specific electric resistance, forms a shunt of the copper core which affects the current-carrying capacity of the fusible element as a whole. This can, however, readily be compensated, and does not present a significant problem.

Fusible elements accordings to this invention were tested to prove their superiority to other high cycling ability fusible elements and these tests confirmed the above claims in regard to their cycling performance.

I claim as my invention:

1. A cycling resistant fusible element for electric fuses comprising (a) a ribbon of copper from which any M-effect overlay is absent;

(b) said ribbon being zig-zag shaped to establish a plurality of contiguous planar sections enclosing obtuse angles with each other and forming straight edges at the loci of intresection of the planes defined by said sections;

(c) said straight edges being non-perforated to maximize the flexual strength thereof;

(d) said sections each having at least one point of reduced cross-section remote from said straight edges;

(e) said ribbon being electroplated with sulfamate of nickel to prevent its oxidation and providing a dull protective layer of high ductility; and (f) the thickness of said layer being in the order of ten thousandth parts of an inch.

2. A fusible element as specified in claim 1 wherein the thickness of said layer is between 0.0002" and 0.00035".

3. A method for manufacturing cycling resistant fusible elements comprising the steps of (a) stamping perforations into a planar ribbon of copper to establish a plurality of serially arranged points of reduced cross-section;

(b) thereafter electroplating said ribbon with sulfamate of nickel to a thickness in the order of ten thousandth parts of an inch; and (c) thereafter bending said strip of copper between said points of reduced cross-section at obtuse angles to zig-zag shape.

* * * * *